United States Patent [19]

Hanik

[11] 4,243,265

[45] Jan. 6, 1981

[54] PATIENT CHAIR SLIPPER

[76] Inventor: Michael Hanik, 220 Summit Hall Rd., Gaithersburg, Md. 20760

[21] Appl. No.: 30,804

[22] Filed: Apr. 17, 1979

[51] Int. Cl.[3] ..... A47C 7/50

[52] U.S. Cl. ..... 297/423; 297/433; 297/219; 297/464; 128/134

[58] Field of Search ..... 36/11.5; 128/134, 153; 297/217, 219, 423, 464, 466

[56] References Cited

U.S. PATENT DOCUMENTS

| | | | |
|---|---|---|---|
| 3,367,327 | 2/1968 | Rybczynski | 128/134 |
| 3,848,922 | 11/1974 | Blanford | 297/219 |

OTHER PUBLICATIONS

DMI (Duro-Med Industries, Inc.), Catalog, 1978, p. 23.

*Primary Examiner*—Francis K. Zugel

*Attorney, Agent, or Firm*—Haight, Rosfeld, Noble & Santa Maria

[57] ABSTRACT

An open-ended slipper suitable for attachment to the footplate of a patient chair and capable of protecting a user's foot from chafing or bruising and maintaining the foot in a generally warm, stable and comfortable condition, comprising a generally rectangular base strip adapted for placement upon a footplate; a first layer of soft protective material attached to the upper surface of the base strip; an upper strip attached along two opposed sides to opposed sides of the base strip but remaining unattached along its remaining opposed sides to create openings for receiving a user's foot; a second layer of soft protective material attached to the lower surface of the upper strip adjacent to the first layer of soft material; and means for attaching and snugly retaining the slipper to the footplate.

15 Claims, 12 Drawing Figures

FIG. 8
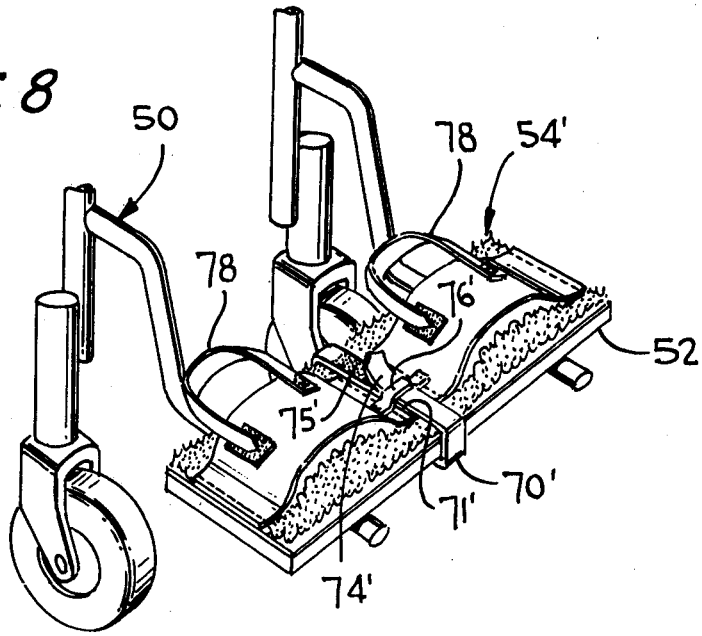
FIG. 11
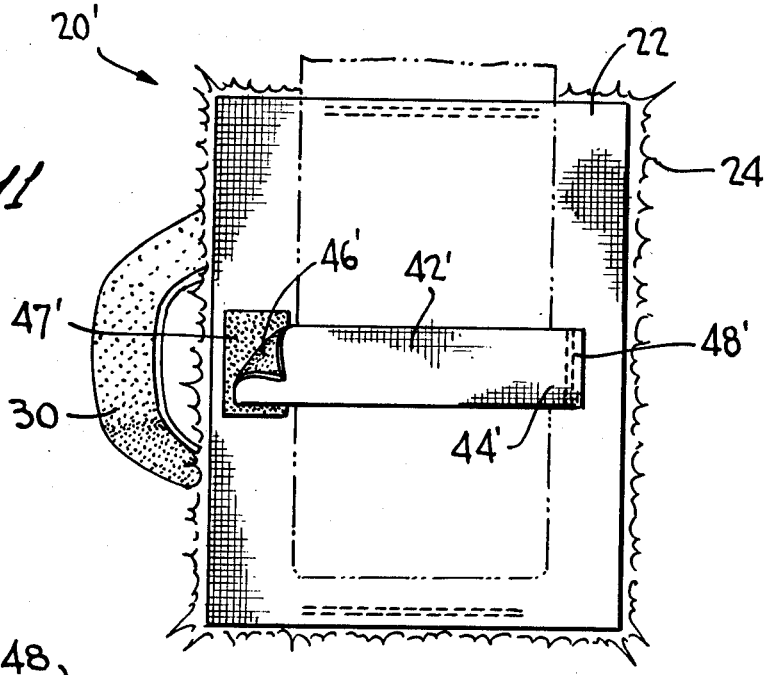
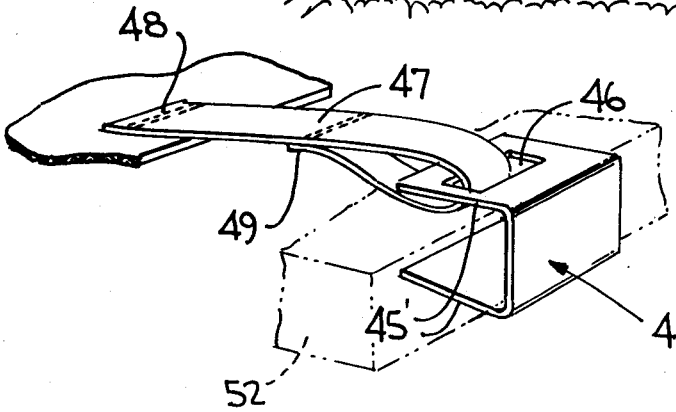
FIG. 7

PATIENT CHAIR SLIPPER

BACKGROUND OF THE INVENTION

The present invention relates generally to wheelchair and other patient chair attachments and more specifically to a new and improved slipper for the feet of users of wheelchairs and other patient chairs which is attached to the footplate of such chairs.

Numerous problems typically arise when a patient, disabled person or other individual is confined to a wheelchair, mobile comfort chair, geriatric chair or other type of patient chair. One problem is that the user's feet are easily chafed or bruised from resting upon a conventional patient chair footplate which is made from a hard material such as rubber or metal. Another problem which confronts the users of such chairs is that their feet often become cold, as they are forced to sit in the chairs for hours at a time. Since the users of such chairs are often incapable of leaving the chair without assistance in order to obtain a pair slippers to cover their feet, it is important that they be able to protect their feet when necessary yet leave them free and comfortable without requiring assistance from another person in order to don the footwear. Still another problem is that the user's feet often slip off the footplate and drag onto the floor, even where conventional slippers are utilized. Further, users may totally fall off of the chair or slump forward in the chair, which is a particular problem with disabled individuals and other users who lack normal body control.

The above problems have generally remained unsolved by the prior art. A decubitus plate cover is known which is designed to easily slide on and off of wheelchair footplates. Such a cover consists of a continuous band of material which slips over a conventional wheelchair footrest plate and which is covered along its entire outer surface by a layer of soft material. The cover assists in the prevention of bed sores and decubitus ulcers, but it is not designed for use as a slipper and cannot be used to cover a user's foot. Additionally, the plate cover does not include any structure which would permit it to be snugly retained upon a wheelchair footplate, nor is any structure provided for retaining a user's foot upon the cover when such retention is desired or necessary.

Other prior art devices have been designed which are utilized to protect and shield a user's feet while in bed but are not adapted for use in conjunction with a wheelchair footplate and could not be used as slippers. For example, Posey, U.S. Pat. No. 3,216,417, discloses a protective shield which can be placed over a patient's foot in order to fully ventilate and cushion the foot against bed sores. The pad includes a generally rectangular sheet which has a smooth, slick exterior surface to facilitate sliding against bed clothes. A soft layer of material designed to fit against a patient's skin is disposed over the sheet in order to prevent chafing and the development of sores. An additional insert of soft absorbent material is also provided for extra protection. This shield, however, is used mainly as a support and protective device and could not easily be adapted for use as a slipper. Furthermore, the shield is not capable of being attached to or retained by a patient chair by itself.

Gaylord, Jr., U.S. Pat. No. 3,937,218, discloses a heel or elbow pad designed to cushion specific body parts and protect against the development of bed sores. The pad includes a body member formed of outer and inner sheets surrounding a core of resilient flexible cushioning material. A strap of woven material is attached to the pad and secured at each of its ends by Velcro or other suitable fastening elements. The pad cannot, however, be attached to a wheelchair footplate by itself. Additionally, the pad is designed for use as a protective device for bed sores rather than as a covering or slipper for a user in a chair, and would be too bulky to be utilized for the latter purpose.

Alessio, U.S. Pat. No. 3,721,237, discloses a urethane foam heel and ankle protector. The protector is wrapped around a user's foot to enable the toes and adjacent foot end to be free, and is attached to itself by a Velcro fastener. The protector has no soft inner coating to prevent chafing or the development of bed sores or ulcers, and cannot therefore be utilized as a protective slipper, nor does the protector include any structure which would permit it to be attached to a wheelchair or other patient chair footplate.

Richardson, U.S. Pat. No. 2,592,739, discloses an ankle support used by athletes for cushioning their feet, preventing sprains and other injuries. The anklet includes an elastic understrap attached to its bottom edges in order to retain the same upon a user's foot. The anklet surrounds a user's lower leg and ankle and does not surround a foot and function as a slipper. Furthermore, the anklet does not include any flat element which could be be placed upon a wheelchair footplate with the aid of a structure that would enable such an element to be retained upon the plate.

Chisholm, U.S. Pat. No. 3,807,520, discloses a motorized wheelchair which includes two footplates, each of which has a heel abutment anchored thereupon. Although these heel abutments are designed to support a user's foot upon the footplate, they are not designed to be slipped over the footplates themselves, nor could such heel attachments be used as slippers to receive a patient's entire foot.

It is clear that all of these prior art devices are incapable of simply and inexpensively providing a slipper for a wheelchair or other patient chair which will be snugly retained upon a footrest plate, preventing a user's foot from chafing or bruising, maintaining the foot in a warm and comfortable condition and keeping the foot in a stable position upon the footplate. None of the prior art devices employs a suitable structure which would enable such a wheelchair attachment to remain upon the footrest whether or not the patient was in the chair, and none allows the user the choice of utilizing or ignoring the slipper while he is sitting upon the chair. All of the above disclosed devices clearly provide for protection of the user's foot, but not for convenience of use and overcoming of the aforementioned problems which confront the users of such wheelchairs.

OBJECTS OF THE INVENTION

Accordingly, it is a general object of the present invention to provide a new and improved patient chair slipper which will protect a user's foot from chafing and bruising while maintaining the same in a generally warm, stable and comfortable condition.

Another object of the present invention is to provide a new and improved patient chair slipper which is adjustable in order that one such slipper will accommodate feet of various sizes.

A further object of the present invention is to provide a new and improved patient chair slipper which can be used with all sizes of geriatric chairs, mobile patient chairs, wheelchairs and similar patient chairs.

An additional object of the present invention is to provide a new and improved patient chair slipper which will retain a user's foot within or upon the slipper, minimizing the danger of the user having his leg slip off from the chair's footplate and maintaining the user in proper sitting position.

Yet another object of the present invention is to provide a new and improved patient chair slipper which will be snugly retained upon a footplate of a patient chair even if jostled or moved by the user.

Upon further study of the specification and appended claims, further objects and advantages of this invention will become apparent to those skilled in the art.

SUMMARY OF THE INVENTION

Briefly, the above and other objects of the present invention are attained in one aspect thereof by providing an open-ended slipper for attachment to the footplate of a patient chair, so that the slipper will protect a user's foot from chafing or bruising and maintain the foot in generally warm, stable and comfortable condition. The slipper includes a wide and generally rectangular base strip which has upper and lower surfaces and which is placed directly upon a chair footplate. A first layer of soft protective material is attached to the upper surface of the base strip to protect the user's foot. A relatively narrow and generally rectangular upper strip which includes an upper and a lower surface is attached along its two narrow opposed sides to opposed sides of the base strip and remains unattached to the base strip along its wider opposed sides in order to create opposed openings for receiving the user's foot. An additional layer of soft protective material is attached to the lower surface of the narrow strip adjacent to the other layer of soft material in order to surround the user's foot with such material. Means for maintaining a user's foot between the narrow upper strip and the base strip and upon the slipper are attached to the upper surface of the base strip. Further, means for attaching the slipper to a footplate and snugly retaining the slipper thereupon are connected to the lower surface of the base strip.

BRIEF DESCRIPTION OF THE DRAWINGS

The above and other objects, features and advantages of the present invention will be more fully apparent to those of ordinary skill in the art to which this invention pertains from the following detailed description when considered in connection with the accompanying drawings, in which like reference characters designate like or corresponding parts throughout the several views, and wherein:

FIG. 7 is a perspective view of a clip and strap attachment which can be attached to either a wheelchair or patient chair footplate;

FIG. 8 is a perspective view of a geriatric chair having an alternate embodiment of an open-ended double slipper in accordance with the present invention attached thereto;

FIG. 11 is a plan view of the underside of the open-ended slipper of FIG. 10.

DETAILED DESCRIPTION OF THE DRAWINGS

Figure 1:
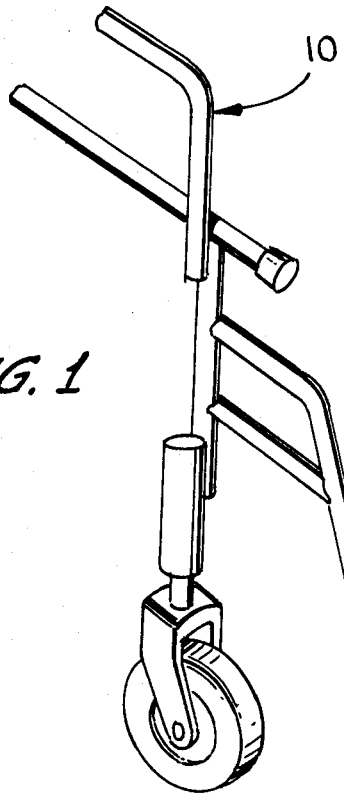
FIG. 1 is a perspective view of the bottom of a conventional wheelchair which has two of the open-ended slippers of the present invention attached to its footplates.

Referring now to FIG. 1 of the drawings, a wheelchair 10 is illustrated which includes two pivoted wheelchair footplates 12 provided near the bottom of the wheelchair for users to rest their feet upon. In accordance with the present invention, an open-ended slipper 20 is attached to each of the wheelchair footplates 12. The open-ended slipper has a relatively wide, generally rectangular base strip 22 attached to a relatively narrow, rectangular upper strip 26 along its two opposed narrow sides. Although strip 26 is illustrated as being quite narrow, it may be of any width as long as it is not wider than base strip 22. The remaining opposed sides of the strips remain unattached in order that a user's foot 14 can be placed between the openings thereby created. A first layer of soft protective material 24 is attached to the upper surface of base strip 22 and a second layer of soft protective material 28 is attached to the lower surface of upper strip 26 in order that the user's foot will be completely surrounded by such soft material to minimize the possibility of the foot becoming chafed and/or bruised and to maintain the foot in a generally warm and comfortable condition. Strips 22 and 26 can be formed from any conventional footgear material, and layers 24 and 28 can be formed of Kodel or other soft material.

Figure 3:
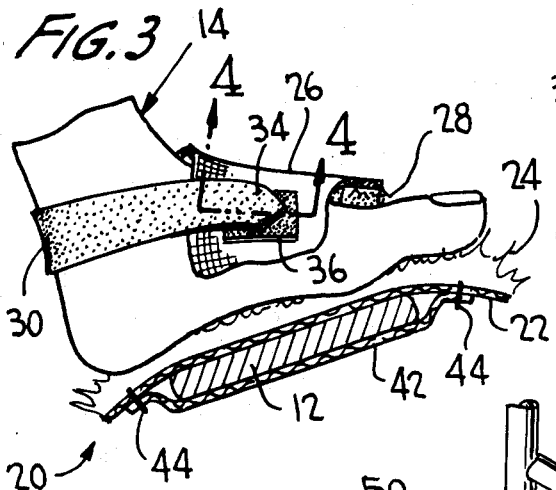
FIG. 3 is a partial cross-sectional cutaway view of the open-ended slipper of the present invention taken along line 3—3' of FIG. 1 and showing the positioning of a patient's foot therein.
Figure 4:
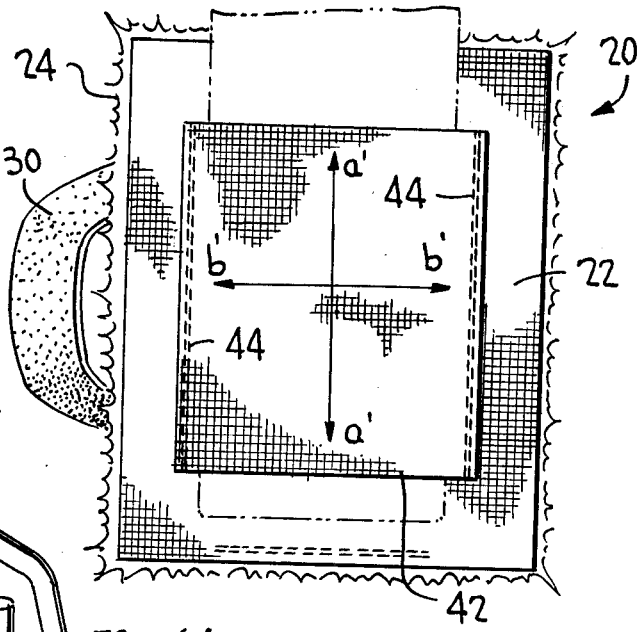
FIG. 4 is a cross-sectional view of the attachment of one end of a heel strap to the open-ended slipper of the present invention taken along line 4—4' of FIG. 3.

A heel strap 30 formed of looped pile material is securely attached at a first end 32 to the upper surface of upper strip 26 by stitches or other attaching means 39. A second end 34 of the heel strap remains loose until the user places his foot between the base and upper strips, at which point strap 30 is placed behind the user's foot 14 and free end 34 of strap 30 is attached to the upper surface of upper strip 26 by a patch of complementary hooks 36 connected to strip 26. As best illustrated in FIGS. 3 and 4, the patch of complementary hooks 36 is securely attached to the upper surface of strip 26 by stitches or other attaching means 40. The hooks on patch 36 and loops of heel strap 30 interlock to retain the heel strap upon the narrow strip and maintain the user's foot between the strips of the open-ended slipper. Similar hooks and loops are utilized for the heel strap connections of all of the slippers of the present invention as well as for some of the retaining straps referred to hereinafter.

Figure 2:
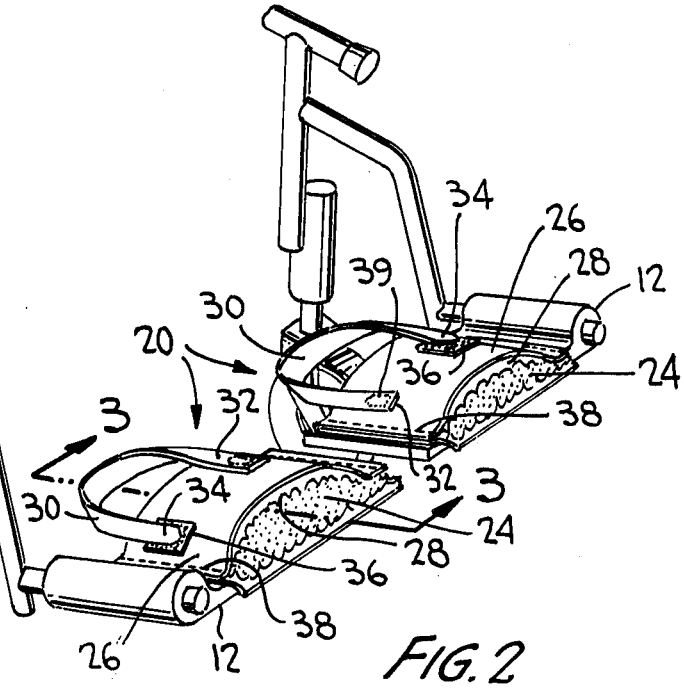
FIG. 2 is a plan view of of the underside of one of the open-ended slippers of FIG. 1.

As best illustrated in FIG. 2, a resilient, generally rectangular band 42 is securely attached along two opposed sides to the underside of the generally rectangular base strip 22 by stitches or other attaching means 44. This band, formed of any durable elastic material, remains unattached to the base strip 22 along its other two opposed sides in order to create opposed openings which can be placed over the wheelchair footplate 12. The opposed openings between the band 42 and strip 22 are situated on axis a'—a' perpendicular to axis b'—b' upon which the openings between strips 22 and 26 are located. Consequently, insertion or removal of the user's foot from the open-ended slipper will not effect the snug retention of the slipper upon plate 12, and there is little danger that the slipper will be accidentally removed from the plate.

Figure 5:
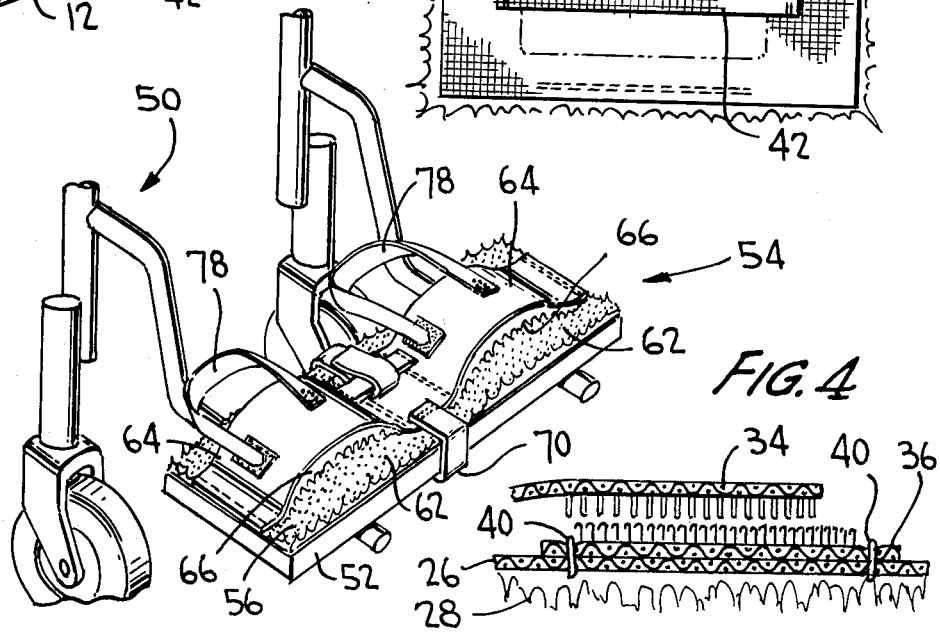
FIG. 5 is a perspective view of a geriatric chair with a single footplate having an open-ended double slipper in accordance with the present invention attached thereto.
Figure 6:
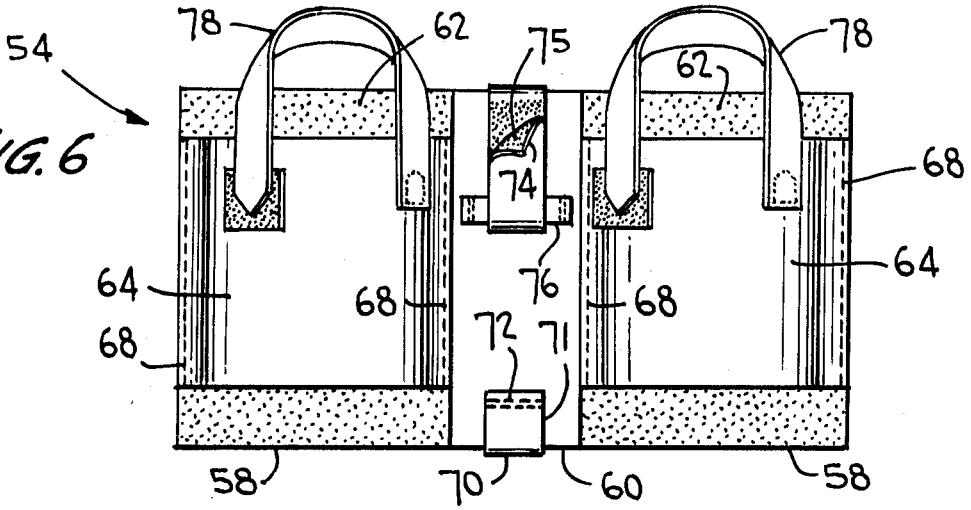
FIG. 6 is a plan view of the upper surface of the open-ended double slipper of FIG. 5.

Alternately, an open-ended double slipper 54, as illustrated in FIG. 5, can be applied to the footplate 52 of a geriatric or other patient chair 50 which has only a single footplate. Slipper 54 includes a wide, generally rectangular base strip 56 having two base strip side portions 58 and a base strip central portion 60 located therebetween, as best illustrated in FIG. 6. Each of the base strip side portions 58 is provided with a first layer of soft and protective material 62, similar to layer 24 of open-ended slipper 20. A relatively narrow, generally rectangular upper strip 64 is attached along its two narrow opposed sides to each of the base strip side portions 58 by means of stitches or other attaching means 68. Although strips 64 are illustrated as quite narrow, they can be of any width as long as they are not wider than base strip 56. The lower surface of each of the narrow upper strips is provided with a second layer of soft and protective material 66, similar to layer 28 of open-ended slipper 20.

Since geriatric and other patient chairs have a single large footplate 52 rather than the two smaller footplates 12 provided in conventional wheelchairs, it is necessary to provide means which are different from elastic band 42 for retaining the open-ended slipper upon the footplate. As illustrated in FIG. 6, a retaining strap 70 formed of looped pile material is attached at a first retaining strap end 71 by stitches or other attaching means 72 to an upper surface of the base strip central portion 60. The strap is then looped underneath the footplate 52 until it reaches around to the opposite side of the upper surface of the base strip central portion 60. The strap is then threaded through a loop 76 which is sewn or otherwise attached to the base strip central portion, and the retaining strap second end 74, which includes a patch of complementary attaching hooks 75, is connected to the looped pile material of the retaining strap in order to secure the same. The loops and complementary hooks are preferably formed of the same material used to secure heel strap 30 to upper strip 26, as illustrated in FIG. 4. By virtue of the fact that the patch of hooks 75 is provided at the end of retaining strap 70, the retaining strap can be pulled as tightly as desired in order to attach itself to any part of the looped pile material of the retaining strap and thereby secure the slipper to the foot plate. Furthermore, heel straps 78, each of which is secured to one upper strip 64 similar to the manner in which heel straps 30 are attached to upper strips 26, are provided to retain both of the user's feet between the rectangular base strip 56 and each of the narrow generally rectangular upper strips 64.

In lieu of the retaining strap 70 and loop 76, at least two combinations of a generally U-shaped plastic clip 45 and a strap 47 can be utilized to attach slipper 54 to patient chair footplate 52. Each clip and strap attachment is to be connected to an opposite side of base strip 56 by attaching a first end 48 of the strap 47 to the base strip by stitches or other conventional means. As illustrated by FIG. 7, the second end 40 of strap 47 is threaded through slot 46 in an upper surface of clip 45 and attached to the strap by stitches or other conventional means. Strap 47 is preferably formed of elastic material, in order that the clip can be stretched to a position adjacent an end of the footplate. Clips 45 are designed so that jaws 45' will be spread apart and will resiliently engage the top and bottom of the footplate 52. The combination clip and strap attachments are preferably attached to opposite sides of base strip central portion 60, so that the clips can be stretched to fit over and around the sides of the footplate, thereby securedly retaining the slipper to the patient chair. Although the attachments are illustrated upon a patient chair footplate, they can equally well replace the band 22 of slipper 20 to retain the slipper upon a wheelchair footplate.

Alternatively, an open-ended double slipper 54', as illustrated in FIG. 8, is provided which is capable of being retained upon a single footplate 52 of a geriatric or other patient chair 50. The double slipper 54' is similar to slipper 54 with the important exception of the means for attaching it to the footplate. An independent retaining strap 70' of looped pile material is provided as a distinct element from the slipper 54', rather than having a first end sewn upon the double slipper. Retaining strap first end 71' is secured to retaining strap second end 74' by means of a patch of hooks 75' attached to the retaining strap second end. Retaining strap 70' acts as a belt and is secured around the slipper 54' and the footplate 52 by being passed through loop 76', which is positioned similarly to loop 76 of slipper 54.

Figure 9:
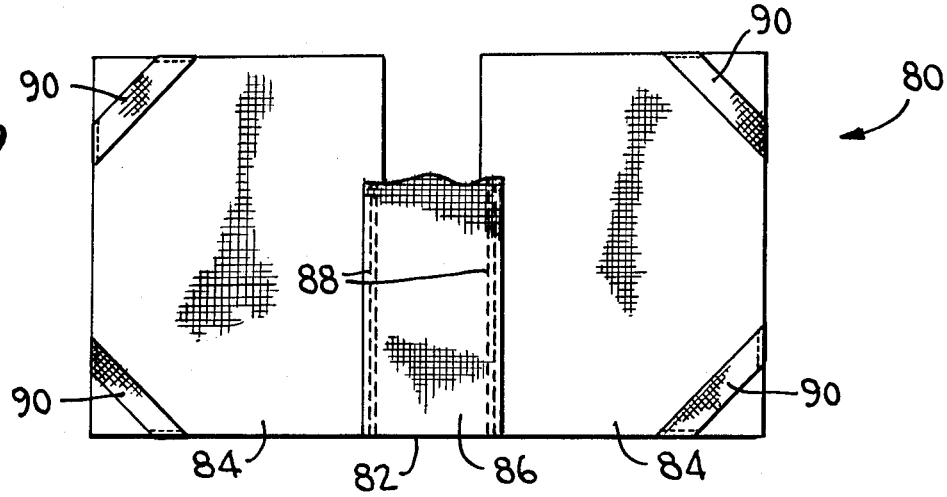
FIG. 9 is a plan view of the underside of yet another embodiment of an open-ended double slipper in accordance with the present invention.

Another alternative embodiment of an open-ended double slipper is provided in which a wide, generally rectangular base strip 82 is not formed of one unitary piece of material, as was rectangular base strip 56 of slipper 54. As illustrated in FIG. 9, base strip 82 includes two base strip side portions 84 which are each attached by stitches 88 or other conventional attaching means along one side to opposed sides of intermediate elastic base strip central portion 86. Elastic central portion 86 is capable of being stretched in all four directions. This is necessary because the means shown for attaching open-ended slipper 80 to a footplate 52 consists of four elastic dog ears 90, each of which is sewn diagonally across one of the corners of the underside of base strip 82. By stretching the base strip over a footplate 52, each of the dog ears will catch one of the corners of the footplate in order to secure the slipper upon same. Each of the dog ears is attached to the bottom of the base strip 52 by means of stitching or other conventional attachment means. The upper surface (not shown) of the double slipper 80 is similar to that of slipper 54, with the chief exception being that the loop 76 and retaining strap 70 have been eliminated due to the replacement of base strip central portion 60 by elastic central portion 86 and the addition of dog ears 90. The upper surface of central portion 86 is free of soft and protective material, as is base strip central portion 60 of slipper 54.

Figure 10:
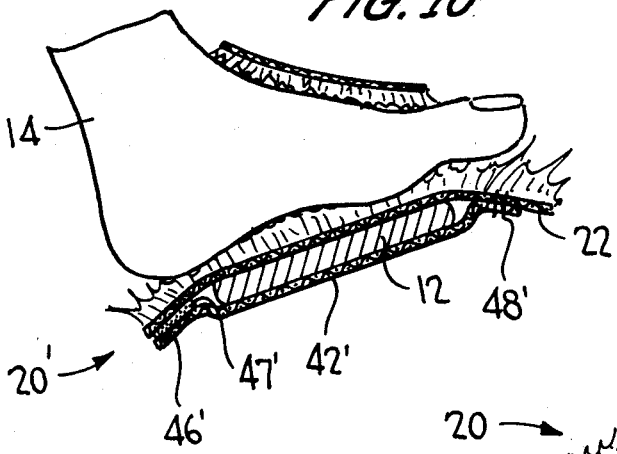
FIG. 10 is a cross-sectional view of an open-ended slipper similar to that of FIG. 1 in accordance with another embodiment of the present invention.

A further embodiment of the slipper of the present invention can be used in conjunction with either the wheelchair footplates 12 or geriatric chair footplate 52. As best illustrated in FIGS. 10 and 11, an open-ended slipper 20' is provided which is similar to open-ended slipper 20, except for the means of retaining the slipper upon the wheelchair plate 12. A retaining strap 42' of looped pile material is attached at a retaining strap first end 44' to the underside of base strip 22 by means of stitches 48'. A retaining strap second end 46' is then pulled around the footplate 12 or 52 and the loops are placed into engagement with a patch of complementary attaching hooks 47' which is sewn or otherwise securedly connected to the underside of base strip 22. By placing two of the open-ended slippers 20' upon a geriatric or other patient chair footplate 52, one of the larger, double slippers of the present invention can be replaced.

Figure 12:
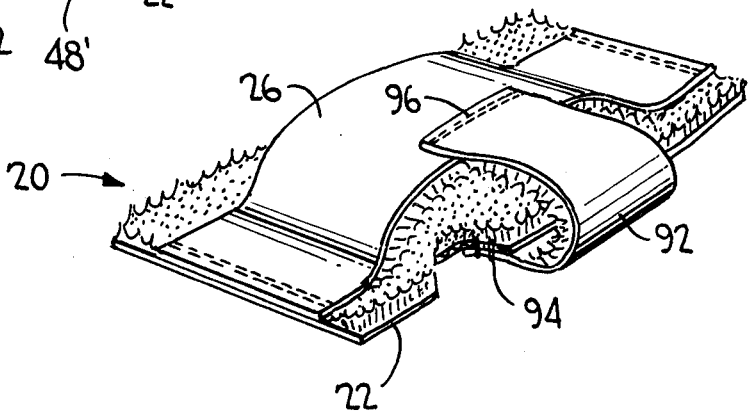
FIG. 12 is a perspective cutaway view of a toe strap which can be attached to any of the slippers of the present invention.

Any of the slippers of the present invention can be utilized in conjunction with a toe enclosure comprising a toe strap 92, although FIG. 12 demonstrates the utilization of such a toe strap in conjunction with the open-ended slipper 20. The toe strap is provided when desired to close off all or a part of the open end of any of the slippers adjacent the user's toes in order to further maintain them in a warm and comfortable condition. The toe strap is attached to the upper surface of upper strip 26 by means of stitches or other attachment means 96 and to the lower surface of base strip 22 by means of stitches or other attachment means 94.

In use, any of the open-ended slippers of the present invention are placed upon the footplate of the wheelchair or other patient chair which is being utilized. As it is immaterial in which direction the heelstraps are positioned, all of the slippers can be formed with their heel straps being uniformly attached. This reduces the cost and greatly simplifies manufacturing of the open-ended slippers. Once the patient inserts his feet between the upper and base strips of any of the slippers of the present invention, the loose end of the heel strap is placed behind the user's foot and into securement with the patch of hooks which engage the looped material of the heelstrap. This prevents a user's foot from being accidentally removed from the slipper and minimizes the possibility of disabled users accidentally slipping or falling from the chair.

From the foregoing description, one skilled in the art can easily ascertain the essential characteristics of this invention and, without departing from the spirit and scope thereof, can make various changes and modifications of the invention to adapt it to various usages and conditions.

What is claimed is:

1. An open-ended slipper suitable for attachment to the footplate of a patient chair or similar device, said slipper being capable of protecting a user's foot from chafing or bruising and maintaining the foot in a generally warm, stable and comfortable condition, said slipper comprising:

(a) a generally rectangular base strip having an upper surface and a lower surface, said base strip adapted for placement upon said footplate;

(b) a first layer of soft protective material attached to said base strip upper surface;

(c) a generally rectangular upper strip having an upper surface and a lower surface, said upper strip being attached along two opposed sides to opposed sides of said base strip, said upper strip remaining unattached to said base strip along its remaining opposed sides to create opposed openings between said strips for receiving a user's foot;

(d) a second layer of soft protective material attached to the lower surface of said upper strip adjacent to said first layer of soft material; and (e) means for attaching said slipper to said footplate and for snugly retaining said slipper upon said footplate, said means being releasably attached to said base strip and comprising a resilient, generally rectangular band attached along two opposed sides thereof to said base strip, said band remaining unattached along its other opposed sides in order to create opposed openings between said base strip and said band so that said band can be stretched over said footplate in order to prevent the slipper from being accidentally displaced from said footplate.

2. An open-ended slipper according to claim 1, wherein said opposed openings between said strips and said opposed openings between said base strip and said band are positioned along axes perpendicular to one another.

3. An open-ended slipper according to claim 1, wherein said means for attaching and retaining said slipper upon a footplate comprises:

(a) a retaining strap connected at one end thereof to one edge of said base strip;

(b) a patch of material attached to an opposed edge of said base strip; and (c) means on the other end of said strap for securing said strap to said patch, said strap being of sufficient length to be placed underneath said footplate and have said securing means placed into securement with said patch.

4. An open-ended slipper according to claim 3, wherein said strap is formed of looped pile material and said patch includes complementary attaching hooks.

5. An open-ended slipper according to claim 1, wherein said slipper further comprises a heel strap for surrounding the back of a user's foot when it is placed within said slipper and for maintaining said foot between said strips.

6. An open-ended slipper according to claim 5, wherein said heel strap is formed of looped pile material attached at one end to one side of said upper strip and a patch of complementary attaching hooks is attached to the other side of said upper strip so that the other end of said heel strap can be secured to said patch.

7. An open-ended slipper according to claim 1, further comprising a toe enclosure which includes a toe strap and means for attaching said toe strap to said upper strip and said base strip.

8. An open-ended slipper suitable for attachment to the footplate of a patient chair or similar device, said slipper being capable of protecting a user's foot from chafing or bruising and maintaining said foot in a generally warm, stable and comfortable condition, said slipper comprising:

(a) a generally rectangular base strip having an upper surface and a lower surface, said base strip including a central portion and two side portions and being adapted for placement upon said footplate;

(b) a first layer of soft protective material attached to said base strip upper surface over said side portions;

(c) two generally rectangular upper strips, each upper strip having an upper surface and a lower surface and being attached along two opposed sides to a respective one of said base strip side portions, each upper strip remaining unattached to said base strip along its remaining opposed sides in order to create opposed openings between said strips for receiving a user's foot;

(d) a second layer of soft protective material attached to the lower surface of each of said upper strips adjacent said first layer of soft material; and (e) means for attaching said slipper to said footplate and for snugly retaining said slipper upon said footplate, said means being releasably connected to said base strip and comprising four elastic corner straps, each strap being diagonally connected across one corner of the base strip lower surface.

9. An open-ended slipper according to claim 8, wherein said base strip central portion is an elastic material sewn along opposed sides to said base strip side portions.

10. An open-ended slipper according to claim 8, wherein said means for attaching and retaining said slipper upon a footplate comprises at least two generally U-shaped clips and associated straps.

11. An open-ended slipper according to claim 9, wherein said means for attaching and retaining said slipper upon a footplate comprises a loop attached to said base strip central portion and a retaining strap formed of looped pile material, said strap being attached at one end thereof to said base strip central portion and having a patch of complementary attaching hooks at its other end, so that said strap can attach said base strip to said footplate by passing said strap underneath said footplate, through said loop and having said hooks engage said looped pile material.

12. An open-ended slipper according to claim 8, wherein said means for attaching and retaining said slipper upon a footplate comprises a loop attached to said base strip central portion and an independent retaining strap formed of looped pile material having a patch of complementary attaching hooks at one end thereof, so that said strap can attach base strip to said footplate by passing said strap underneath said footrest, through said loop and having said hooks engage said looped pile material.

13. An open-ended slipper according to claim 8, further comprising heel straps for surrounding the back of each of said user's feet and maintaining said feet between said base strip and said upper strips when they are placed in the slipper.

14. An open-ended slipper according to claim 13, wherein each of said heel straps is formed of looped pile material sewn at one end to one side of one of said upper strip upper surfaces and a patch of complementary hooks is attached to the other side of one of said upper strip upper surfaces so that the other end of each of said heel straps can be secured to said patch.

15. An open-ended slipper according to claim 8, further comprising a toe enclosure for each upper strip which includes a toe strap and means for attaching said toe strap to said upper strip upper surfaces and said base strip lower surface.

* * * * *